United States Patent [19]

Phillips

[11] 4,055,867

[45] Nov. 1, 1977

[54] MATTRESS HAVING AN INTERNAL FLUID CONTAINING CHAMBER

[76] Inventor: Raymond M. Phillips, 305 Poquito Lane, Topanga, Calif. 90290

[21] Appl. No.: 623,445

[22] Filed: Oct. 17, 1975

Related U.S. Application Data

[63] Continuation-in-part of Ser. No. 581,262, May 27, 1975, Pat. No. 4,006,501.

[51] Int. Cl.[2] ..... A47C 27/08

[52] U.S. Cl. ..... 5/371; 128/376

[58] Field of Search ..... 5/370, 371; 128/376

[56] References Cited

U.S. PATENT DOCUMENTS

| | | | |
|---|---|---|---|
| 3,778,852 | 12/1973 | Penn et al. | 5/371 |
| 3,802,004 | 4/1974 | Whitney | 5/60 |
| 3,803,647 | 4/1974 | Reswick | 5/367 |
| 3,840,921 | 10/1974 | Labinco | 5/371 |
| 3,842,455 | 10/1974 | Whitney | 5/371 |
| 3,918,110 | 11/1975 | Cantillo et al. | 128/376 |
| 3,925,835 | 12/1975 | Pennington et al. | 5/371 |

*Primary Examiner*—Paul R. Gilliam
*Assistant Examiner*—A. M. Calvert
*Attorney, Agent, or Firm*—Robert J. Schaap

[57] ABSTRACT

A mattress having an upper fluid containing chamber and a lower chamber filled with a material rendering it effectively more rigid and which surrounds a portion of the fluid chamber. The mattress is comprised of upper and lower flexible sheets which are provided with peripherally extending downwardly and upwardly struck flaps, respectively, at their outer peripheral ends. These flaps are sealed to each other in order to form a completely enclosed mattress. A tapered, angularly struck inner peripheral wall extends effectively between the upper and lower walls of the mattress in such manner that the upper end of the inner peripheral wall extends to the outer peripheral margin of the upper wall and the lower end of the inner peripheral wall terminates inwardly of the outer peripheral margin of the lower wall. In this way, the inner peripheral wall operates in conjunction with the upper wall in order to form an inner fluid chamber which is essentially coextensive with the entire upper surface of the upper wall. A lower chamber is formed by the other side of the inner peripheral wall, the outer wall and the lower wall. Thus, the lower chamber increases in size with the increased depth in the outer peripheral wall. The inner peripheral wall and the flaps which form the outer peripheral wall may be either lap sealed or otherwise butt sealed to each other in accordance with the present invention. The present invention also provides a unique method of making the mattress of the present invention.

34 Claims, 24 Drawing Figures

MATTRESS HAVING AN INTERNAL FLUID CONTAINING CHAMBER

RELATED APPLICATION

This application is a continuation-in-part of Application Ser. No. 581,262, filed May 27, 1975, now U.S. Pat. No. 4,006,501 issued Feb. 8, 1971.

BACKGROUND OF THE INVENTION

This invention relates in general to certain new and useful improvements in mattresses having fluid containing internal chambers and the method of making the same and, more particularly, to mattresses of the type stated which include an upper fluid chamber which is surrounded by a lower material containing chamber but which permits the upper chamber to be substantially contiguous with a portion of the upper surface of the mattress.

In recent years, water beds have become widely commercially acceptable and have found substantially increased use. It has now been fairly well recognized that water beds, that is those forms of beds which employ a water filled mattress, have not only enjoyment value, but therapeutic value as well. In general, it has been found that many people find that it is not only more enjoyable, but is more restful to sleep on a water bed mattress than other forms of conventional mattresses filled with solid, but nevertheless, resilient, material.

The present commercially available water bed mattresses generally comprise a rectangular shell formed primarily of some form of a fairly flexible plastic material and which is filled with water. This form of water bed mattress is thereupon supported in, and by virture of its construction is required to be supported in, a rigid frame.

In recent years, there have been various other forms of water bed mattresses which include an air frame peripherally surrounding a water bladder, as for example in the Penn et al. U.S. Pat. No. 3,778,852, and the Pennington et al. U.S. Pat. No. 3,787,907. This latter form of water bed mattress, which includes a surrounding air frame, is typically referred to as an air frame water bed mattress. These air frame mattresses differ substantially from the pure water bed mattress, without the air frame, in that those mattresses including the air frame do not require the employment of a rigid structural frame.

The presently available water bed mattresses which do not include the air frame suffer from a large number of deficiencies such as the fact that these mattresses do not obviate the problem of wave action created in the water in the water chamber due to a sudden localized force. Consequently, when a person lies upon a water bed mattress without the surrounding air frame, the water shifts substantially thereby creating substantial wave action and also the attendant displacement of the surface contour of the mattress.

The other forms of water bed mattresses including the air frame surrounding the water bladder, as exemplified by the Penn et. al. Patent and the Pennington et al. Patent mentioned above, also suffer from a number of substantial disadvantages. It has again been well established that those water beds which include the surrounding air frame and which avoid the necessity of a rigid frame do not provide the required degree of comfort. It has been theorized that these water bed mattresses eliminate some of the wave action which is created by a sudden localized force. Nevertheless, it is also well established that the air bladder is relatively incompressible with respect to the water bladder. Consequently, the water bed mattresses which include the surrounding air frame do not provide constant and adequate support. The same generally holds true of those water bed mattresses which do not employ the air frame surrounding the water bladder. One of the primary problems of each of these conventional water beds is that they do not provide equal water flotation with respect to the entire upper surface of the water bed mattress.

Another important disadvantage with respect to the water bed mattresses of each of the aforementioned types is that they are not constantly sized with respect to a supporting structure or, otherwise, a supporting frame. Consequently, difficulty often arises in fitting the water bed mattress, when filled with water, or otherwise with water in the water bladder and air in the air bladder, to the supporting frame or a supporting structure. Even more importantly, these water bed mattresses which are presently commercially available do not provide any adequate safety feature in the event of punctures in the mattress itself which could result in immediate and substantially discharge of water with resultant damage.

The present invention obviates these and other problems in the provision of a fluid containing mattress which includes a pair of upper and lower sheets having peripherally extending, perpendicularly struck side wall flaps. These side wall flaps are secured to each other in order to form an outer peripheral end wall, thereby defining a rectangularly shaped water bed mattress. An inner peripheral wall which is tapered extends between the upper and lower walls. This inner peripheral wall extends substantially toward the outer peripheral margin of the upper wall and is inwardly spaced from the outer peripheral margin of the lower wall and is sealed thereto. In this way, an upper fluid chamber is established between the upper wall, the bottom wall and the inner peripheral wall. Moreover, a lower chamber is established by the outer wall, the lower wall and the inner peripheral wall. In accordance with this construction, the fluid chamber is substantially contiguous with the upper wall so that a person lying on the mattress is completely supported by the fluid chamber with constant flotation. Nevertheless, the lower chamber contains a material which renders it essentially more rigid and surrounds the outer edge of the entire mattress, although the party lying on the mattress does not actually contact the lower chamber portion.

It is therefore the primary object of the present invention to provide a water bed mattress which includes a fluid chamber having a surface substantially across the entire upper surface of said mattress and which is capable of supporting an individual, and a lower chamber surrounding at least a lower portion of the fluid chamber.

It is another object of the present invention to provide a mattress of the type stated which is relatively light in weight, when filled with water or comparable fluid in the fluid chamber, compared to commercially available forms of water bed mattresses.

It is a further object of the present invention to provide a mattress of the type stated which provides constant body support on the upper surface thereof.

It is an additional object of the present invention to provide a mattress of the type stated which is capable of reducing wave action in the fluid chamber of the mattress created by the impingement of localized forces.

It is also an object of the present invention to provide a mattress of the type stated which is durable in its construction and provides a safety feature substantially greater than any conventional available form of water bed mattress.

It is another salient object of the present invention to provide a method of making the mattress of the type stated which is highly efficient in its operation and requires a minimal amount of manual labor.

With the above and other objects in view, my invention resides in the novel features of form, construction, arrangement and combination of parts presently described and pointed out in the claims.

BRIEF DESCRIPTION OF THE DRAWINGS

Figure 1:
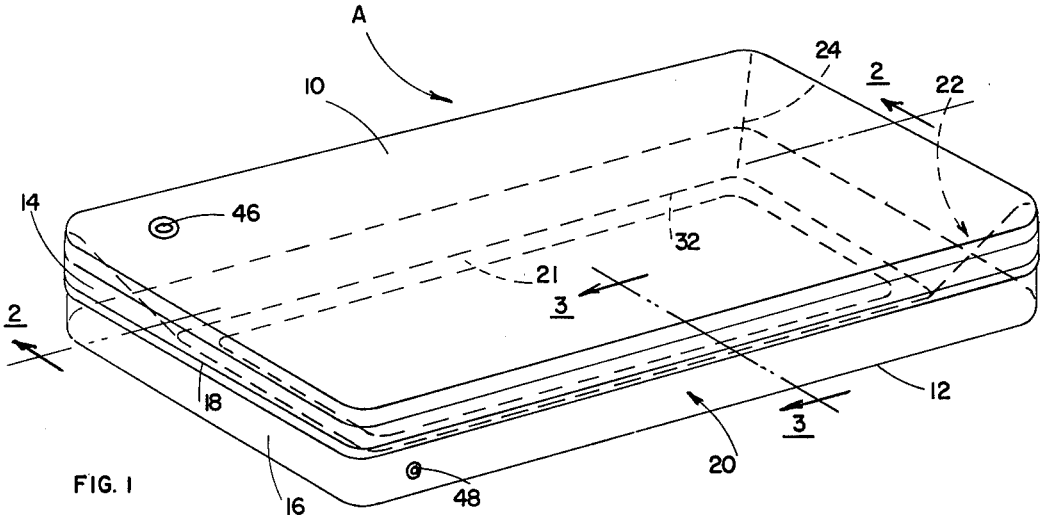
Figure 2:
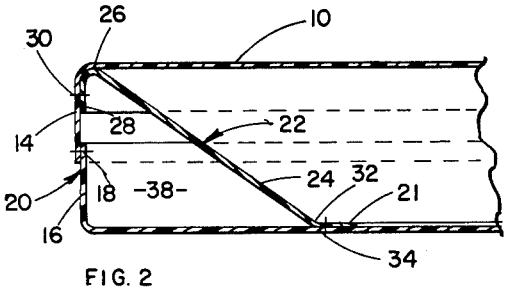
Figure 3:
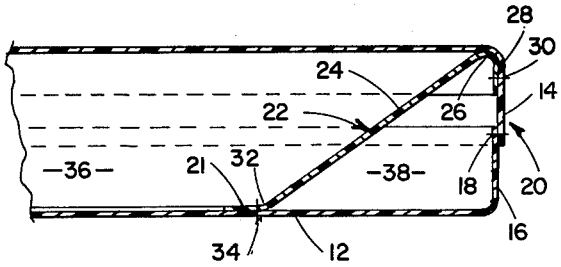
Figure 3:
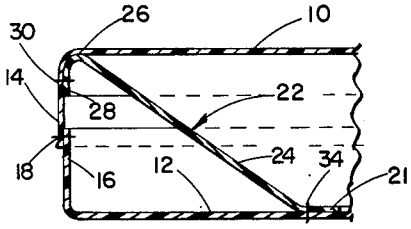
Figure 5:
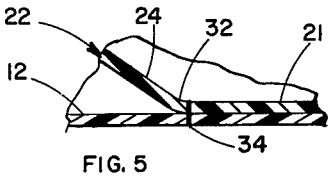
Figure 4:
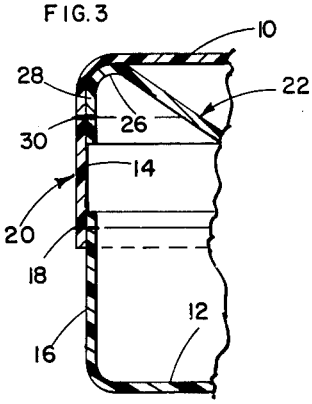
Figure 6:
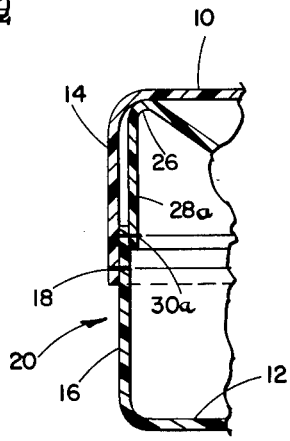
Figure 7:
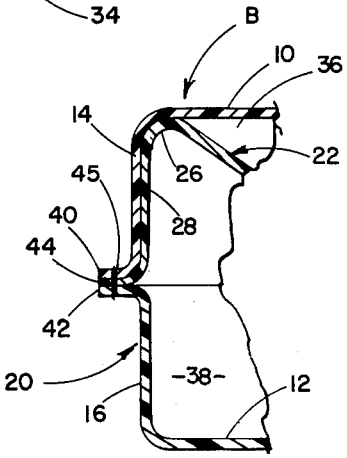
Figure 8:
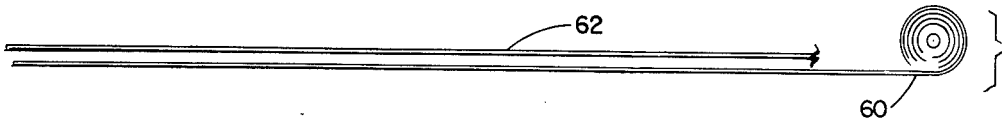
Figure 9:
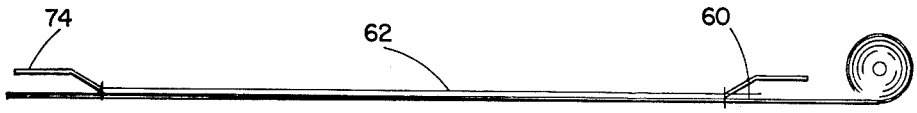
Figure 10:
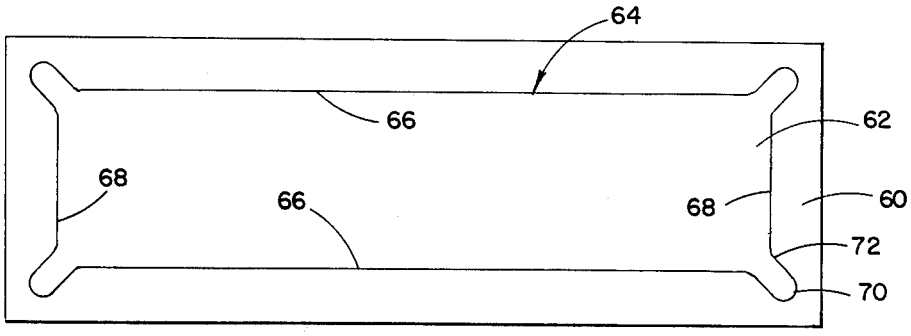
Figure 11:
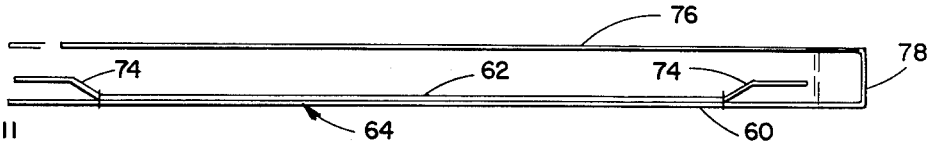
Figure 12:
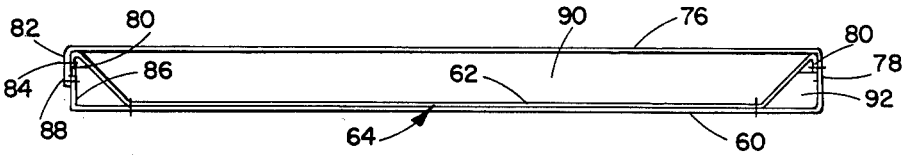
Figure 13:
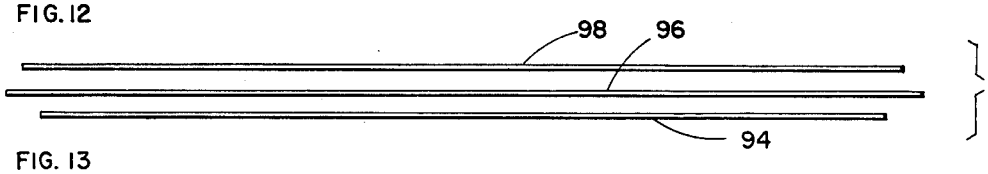
Figure 14:
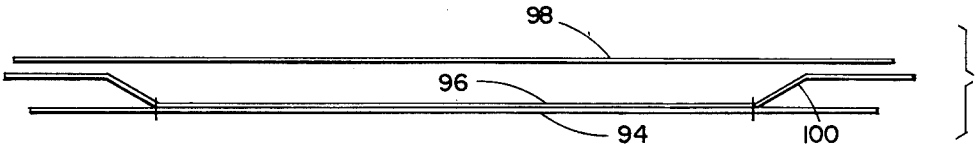
Figure 15:
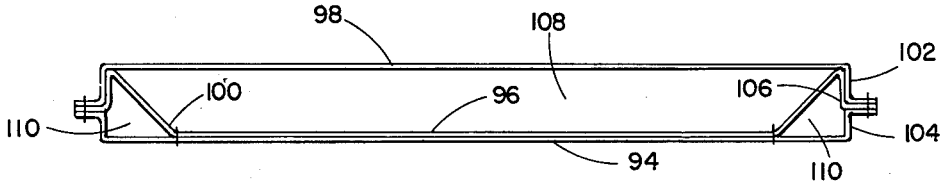

Having thus described the invention in general terms, reference will now be made to the accompanying drawings in which:

FIG. 1 is a perspective view of a water bed mattress, partially shown in phantom lines, constructed in accordance with and embodying the present invention;

FIG. 2 is a fragmentary vertical sectional view taken along line 2—2 of FIG. 1;

FIG. 3 is a fragmentary vertical sectional view taken along line 3—3 of FIG. 1, and showing a portion of the water bed mattress in a different plane with respect to FIG. 2;

FIG. 4 is a fragmentary vertical sectional view showing the seal between an inner wall and the flanges on the upper and lower walls forming part of the water bed mattress of FIG. 1;

FIG. 5 is a fragmentary vertical sectional view showing the attachment of the inner wall to the lower wall forming part of the water bed mattress of FIG. 1;

FIG. 6 is a fragmentary vertical sectional view, similar to FIG. 4, and showing a modified form of construction of the water bed mattress of FIG. 1;

FIG. 7 is a fragmentary vertical sectional view, similar to FIG. 4, and showing an additional modified form of construction of the water bed mattress of FIG. 1;

FIG. 8 is a schematic side elevational view showing a first step in the manufacture of a water bed mattress of the type illustrated in FIG. 1 of the drawings;

FIG. 9 is a vertical sectional view showing a second step in the manufacture of the water bed mattress of FIG. 1 and specifically illustrating the attachment of an inner sheet to the lower sheet forming part of the water bed mattress;

FIG. 10 is a top plan view showing the arrangement of the sheets illustrated in FIG. 9 of the drawings;

FIG. 11 is a vertical sectional view, similar to FIG. 9, and showing a third step in the manufacture of the water bed mattress of FIG. 1;

FIG. 12 is a vertical sectional view, similar to FIG. 11, and showing the completion steps in the manufacture of the water bed mattress of FIG. 1;

FIG. 13 is a vertical sectional view, similar to FIG. 8, and showing the various layers used in the manufacture of the modified form of water bed mattress which is more fully illustrated in FIG. 7 of the drawings;

FIG. 14 is a vertical sectional view, similar to FIG. 13, and showing a second step in the manufacture of the water bed mattress to produce that water bed mattress structure more fully illustrated in FIG. 7; and FIG. 15 is a vertical sectional view, similar to FIG. 14, and showing the completion steps in order to produce the water bed mattress illustrated in FIG. 7 of the drawings.

Figure 17:
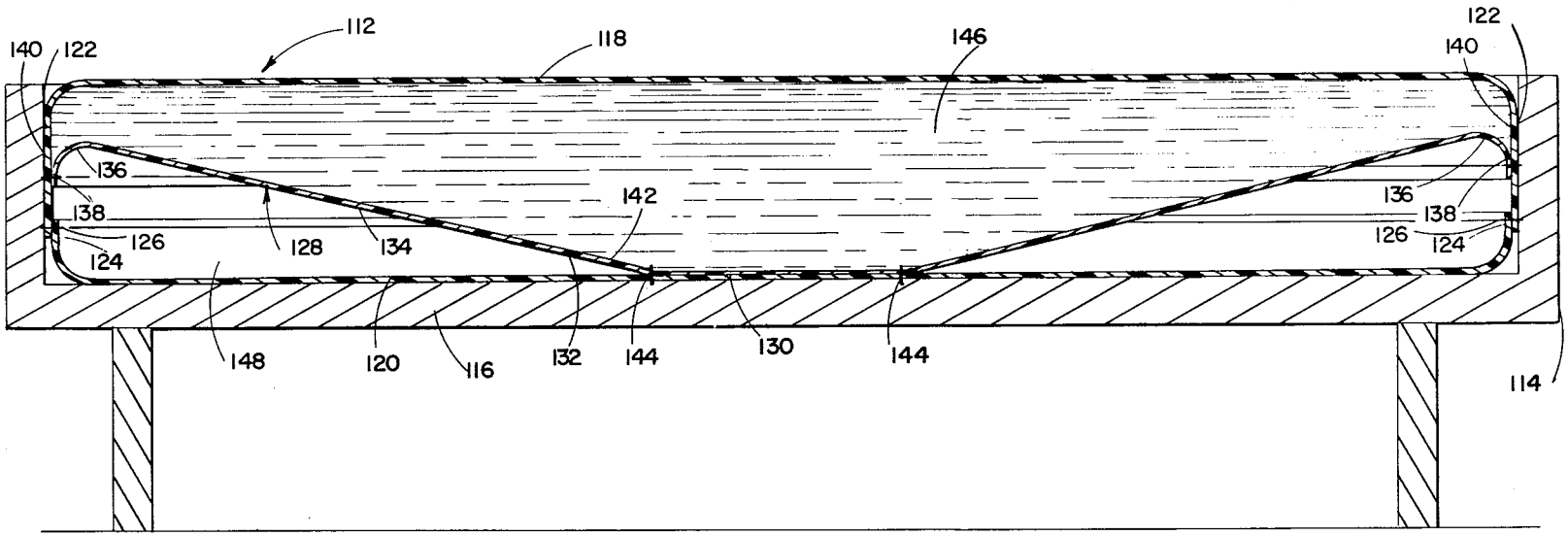
Figure 16:
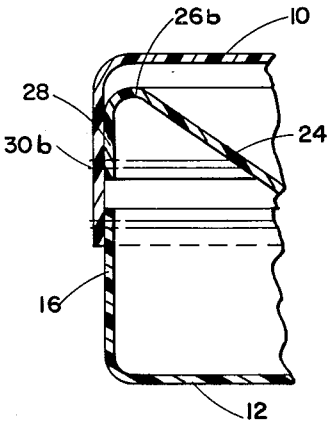
Figure 18:
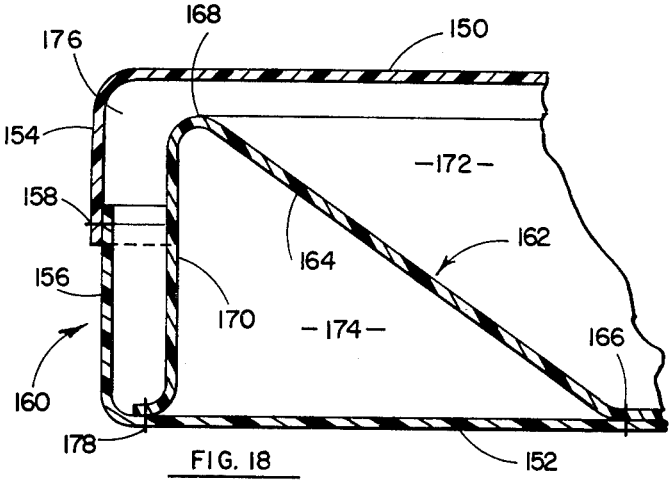
Figure 19:
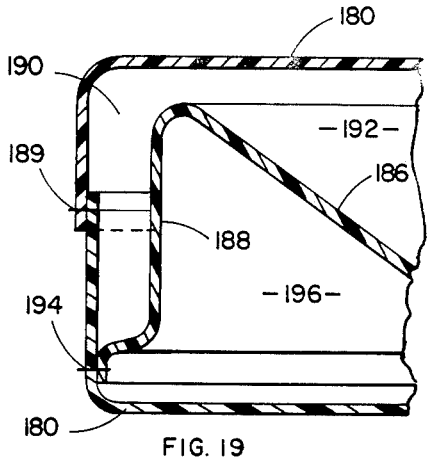
Figure 20:
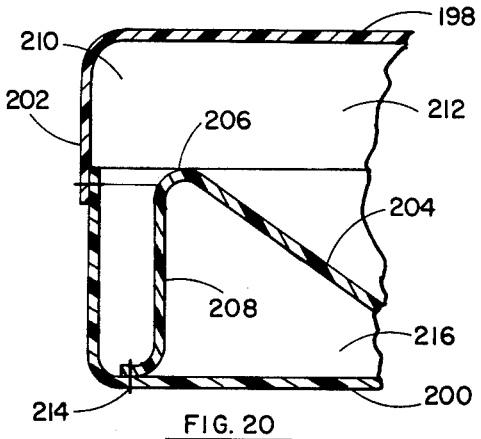
Figure 21:
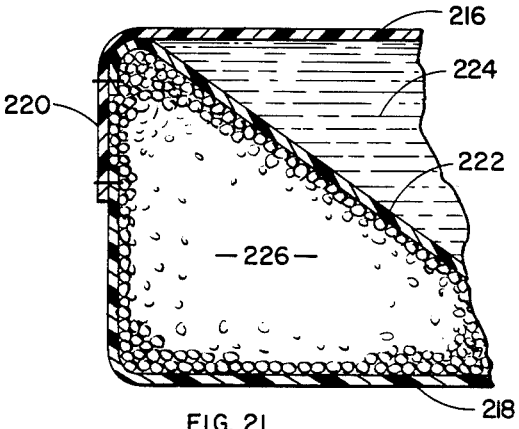
Figure 22:
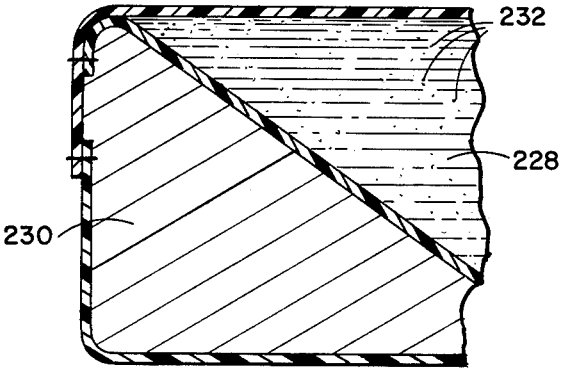
Figure 23:
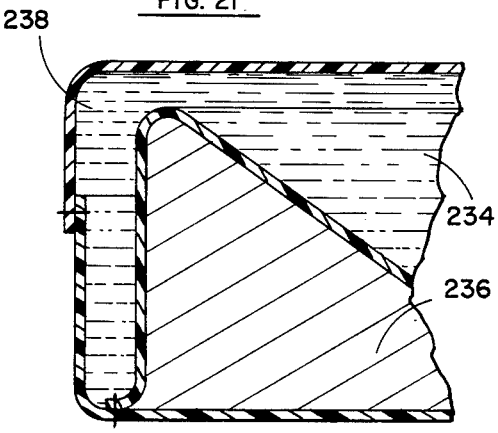
Figure 24:
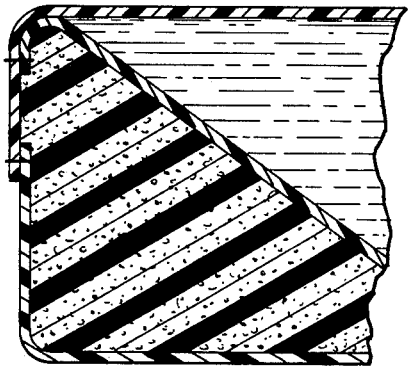

FIG. 16 is a further fragmentary vertical sectional view, similar to FIG. 5, and showing still a further modified form of water bed mattress constructed in accordance with and embodying the present invention;

FIG. 17 is a vertical sectional view, taken along a transverse plane, and showing a preferred form of water bed mattress constructed in accordance with and embodying the present invention;

FIG. 18 is a fragmentary vertical sectional view of an additional modified form of water bed mattress constructed in accordance with and embodying the present invention and which illustrates the fluid chamber extending along the entire periphery of the mattress;

FIG. 19 is a fragmentary vertical sectional view, similar to FIG. 18, and showing a slightly different form of construction of the water bed mattress of FIG. 18;

FIG. 20 is a fragmentary vertical sectional view, similar to FIG. 18, and showing still another modified form of construction of the water bed mattress similar to FIG. 18;

FIG. 21 is a fragmentary vertical sectional view constructed in accordance with and embodying the present invention and showing the utilization of a somewhat solid material filled lower chamber;

FIG. 22 is a fragmentary vertical sectional view, similar to FIG. 21, and showing a modified form of mattress similar to that of FIG. 21, but which incorporates a different form of fluid containing material in the fluid chamber of the mattress;

FIG. 23 is a fragmentary vertical sectional view of still a further modified form in accordance with the present invention also utilizing a somewhat solid material filled lower chamber; and FIG. 24 is a fragmentary vertical sectional view of a modified form of mattress which is constructed in accordance with and embodies the present invention, and which is similar in construction to the water bed mattress of FIG. 21.

DETAILED DESCRIPTION

Referring now in more detail and by reference characters to the drawings which illustrate preferred embodiments of the present invention, A designates a water bed mattress comprising an upper flexible plastic sheet 10 and a lower flexible plastic sheet 12, and both of which are substantially rectangular in their construction, but with rounded corner margins.

The upper and lower sheets 10 and 12 are both substantially of the same overall size and are marginally registered with each other, and the upper sheet includes an integrally formed downwardly struck peripherally extending end flap 14. In like manner, the lower wall 12 includes an integrally formed upwardly struck peripherally extending flap 16 which is lap-sealed to the end flap 14 at a seal 18 thereby forming a peripheral outer end wall 20. In this case, it can be observed that the flap 14 which is integral with the upper wall 10 is located exteriorly of the flap 16 in order to form the lap-seal 18. However, it should also be understood that the flap 16 could be located exteriorly of the flap 14 in order to form the lap-seal 18.

The water bed mattress of the present invention also includes a flexible plastic intermediate sheet 21 which is disposed on the interiorly presented surface of the lower sheet 12 and which is integrally provided with a somewhat tapered peripherally extending inner side wall 22 which is more fully illustrated in FIGS. 1–4 of the drawings. This inner peripheral wall 22 includes a diagonally inwardly and downwardly extending relatively straight wall section 24 merging into the intermediate sheet 21 and which wall section 24 is formed at its upper end with an arcuately shaped section 26. This arcuately shaped section 26, in turn, integrally merges into a downwardly extending flange 28 which is essentially located in juxtaposition to the downwardly struck flap 14, in the manner as illustrated in FIGS. 2–4 of the drawings. The downwardly struck flap 28 is lap-sealed to the interior surface of the flap 14 by means of a lap-seal 30, as more fully illustrated in FIGS. 3 and 4 of the drawings.

The peripheral margin 32 of the intermediate sheet 21, that is the location where the sheet 21 merges into the side wall 22, is lap-sealed to the lower sheet 12 by means of a lap-seal 34, in the manner as illustrated in FIG. 5 of the drawings. As an alternate construction, the sheet 21 could be eliminated and the lower and inner peripheral end of the peripheral inner side wall 22 could be integrally provided with an end flange which is lap-sealed to the lower sheet 12.

By reference to FIGS. 1 through 4 of the drawings, it can be observed that the arcuately shaped section 26 of the inner peripheral wall 22 is located substantially near, if not at the very end, of the peripheral margin of the upper wall 10, inasmuch as the curved section 26 is located at the corner margin extending between the upper wall 10 and the downwardly struck flap 14. Moreover, and by reference to FIGS. 2 and 3, it can be observed that the straight section 24 of the wall 22 terminates at the margin 32 substantially inwardly of the outer peripheral end margins of the lower wall 12.

In accordance with the above-outlined construction, it can be observed that the upper sheet 10 and the inner peripheral wall 22, along with the intermediate sheet 21 on the lower sheet 12, defines a water chamber 36. Moreover, it can be observed that the other side of the inner peripheral wall 22, along with the bottom wall 12 and the side wall 20, forms an outer air chamber 38. By further reference to FIGS. 2 and 3 of the drawings, it can be observed that the water chamber is substantially contiguous with the entire upper surface of the upper wall 10 in such manner that the entire upper surface of the water bed mattress A is defined only by the water chamber. Nevertheless, it can be observed that an air chamber 38 extends peripherally around the entire outer wall of the water bed mattress A and, in this way, the air chamber increases in size with the increased depth in the outer peripheral wall 22.

FIG. 6 illustrates a modified form of water bed mattress constructed in accordance with and embodying the present invention and differs only from the water bed mattress previously described in that the downwardly struck flange 28 is a somewhat longer flange designated as 28*a* and which is heat-sealed to the upwardly struck flap 16 by means of a heat seal 30*a*. Otherwise, the construction of the water bed mattress, as illustrated in FIG. 6, is substantially identical to the construction of the water bed mattress illustrated in FIGS. 1–5 of the drawings. The water bed mattress as illustrated in FIG. 6 of the drawings does not otherwise differ from the water bed mattress illustrated in FIGS. 1–5 of the drawings except that the flange 28*a* is longer and is secured to the lower flap 16, which is sometimes desirable in certain constructions of the water bed mattress A.

FIG. 7 of the drawings illustrates a further modified form of water bed mattress B which similarly includes the top wall 10 having its downwardly struck flap 14 and the bottom wall 12, along with its upwardly struck flap 16, to thereby form the end wall 20. In addition, the water bed mattress B similarly includes the inner peripheral wall 22, as illustrated in FIG. 7, and which includes the downwardly struck flange 28, which is integral with the straight portion of the wall 22 through the curved section 26. In this case, the flap 14 and the flap 16 are provided with integrally formed laterally outwardly struck terminal flanges 40 and 42, respectively. In like manner, the downwardly struck 28, which is integral with the inner peripheral wall 22, is similarly provided with a laterally struck continuously peripherally outwardly struck flange 44.

By further reference to FIG. 7, it can be observed that the flanges 40, 42 and 44 are each butt-sealed to each other. Nevertheless, it can be observed that the water bed mattress B is provided with the inner water chamber 36 and the lower air chamber 38. While not illustrated in FIG. 7 of the drawings, it should also be understood that the lower end of the inner peripheral wall 22 is similarly integral with the intermediate sheet 21 which is heat-sealed and, preferably, lap-sealed to the lower wall 12 by means of the heat seal 34.

In this respect, it should be understood that lap seals are generally preferred in the construction of the water bed mattresses of the present invention inasmuch as they provide a greater degree of safety with respect to the sealing of the various plastic components. Nevertheless, it has also been found that butt seals are also effective in producing a water bed mattress in accordance with the present invention.

The water bed mattress A and B are both provided with a water inlet 46 communicating with the water chamber 36, as well as an air inlet 48 communicating with the air chamber 38. This water inlet 46 and the air inlet 48 may be in the form of fittings which are integral with the respective plastic sheets, as shown and illustrated in FIG. 1 of the drawings, and provided with removable, but nevertheless fluid-tight, caps in order to provide entry and exit of either water or air from the respective chambers 36 and 38.

Several unique features are inherently created by the water bed mattresses of the present invention which include a relatively light weight, compared to other conventional prior art water bed mattresses, due to the large air chamber which surrounds the lower portion of the water chamber. In addition, the water bed mattresses of the present invention provide a more substantially constant support due to the fact that the air bladder is effectively located under the water bladder and which thereby produces a constant flotation on the top of the water bed mattress. In addition, the air chamber 38 serves to effect as a baffle which thereby inhibits water motion and, hence, the wave action which would otherwise be created by a sudden impact or otherwise a localized force impingement on the surface of the water bed mattress. In this way, it can be observed that there is an increased ease of exit and entry with respect to the water bed mattress.

In the conventional complete water bladder mattress, it was virtually impossible to sit on the edge of the water bed inasmuch as the water would displace and the sheet portion in the area of displacement would collapse. In the conventional air frame surrounded water bed mattress, the air frame was too rigid and thereby prevented an effective resting while sitting positional.

In addition to the above, the water bed mattresses of the present invention provide a substantially increased fit with respect to a surrounding support frame. Moreover, the water bed mattresses of the present invention provide a substantially increased safety factor when compared to any other conventional form of water bed mattress. In this case, it can be observed that the air chamber 38 substantially completely surrounds the entire peripheral end wall of the water chamber. Moreover, the air chamber 38 surrounds a substantial quantity of the lower portion of the water chamber 36, such that if any portion of the sheet material forming the water chamber were perforated or otherwise punctured, the air chamber 38 surrounding this water chamber 36 would prevent discharge of any of the water which might otherwise be expelled from the water chamber.

The method of producing the water bed mattresses A and B in accordance with the present invention has been described essentially in connection with the description of the water bed mattresses per se. However, in order to more fully describe the method of making these water bed mattresses A and B, reference will now be made to FIGS. 8–15 of the drawings.

FIGS. 8–12 more fully illustrate the various method steps in constructing the water bed mattress A, the latter of which is more fully illustrated in FIGS. 1–5 of the drawings, as well as the modified embodiment thereof more fully illustrated in FIG. 6 of the drawings. In accordance with producing the water bed mattress A of the present invention, a first sheet 60 is provided and has a size at least approximately equal to the total length of the upper and the lower sheets forming part of the water bed, along with twice the vertical dimension of the peripheral side wall. The sheet 60 is then at least partially unrolled and laid on a flat surface with the unrolled portion having a length equal to the length of the lower sheet in the mattress.

Thereafter, an upper sheet 62 is disposed over the lower sheet 60 in the manner as illustrated in FIG. 8 of the drawings. The intermediate sheet 62 is then heat-sealed to the lower sheet 60, in the manner as illustrated in FIGS. 9 and 10 of the drawings, and along a heat-seal line designated by reference numeral 64 in FIG. 10 of the drawings. This heat seal 64 is preferably a lap seal where the sheet 62 is secured to the lower sheet 60.

It can also be observed that the heat seal 64 has a somewhat quadrilateral, and preferably rectangular, shape including parallel and opposed longitudinal margins 66 and parallel and opposed transverse margins 68. These parallel longitudinal margins 66 and the transverse margins 68 are each connected to each other by elongated outwardly and angularly located end margins or so-called "dog-legs" 70, in the manner as illustrated in FIG. 10. These dog-legs 70 merge into the relatively straight margins 66 and 68 through arcuate corners 72. These outwardly projected elements 70 are provided so that the flange portion 74, that is the portion extending outwardly beyond the heat seal 64, has a similar dimension around its entire peripheral length. Moreover, it can be observed that the distance between the outer peripheral margin of the lower sheet 60 and the heat seal 64 is substantially identical along any portion between the heat seal 64 and the outer peripheral margin of the sheet 60 at any point along the heat seal 64.

After the intermediate sheet 62 has been heat-sealed to the lower sheet 60 along the heat seal 64, the rolled portion of the sheet 60 is unrolled in order to form an upper sheet 76, along with an end wall 78, in the manner as illustrated in FIG. 11 of the drawings. Thereafter, the flanges 74 are bent so that they are located in close proximity to the peripheral end margins of the upper sheet 76, in the manner as illustrated in FIG. 12 of the drawings. These flanges 74 are then bent over to form terminal flange portions 80 and which are heat-sealed to reversely bent flap portions 82 integral with the upper sheet 76 by means of lap seals 84. In this respect, it should be observed that the terminal flange portions 82 are lap-sealed along their entire peripheral margin to the downwardly struck flap 82 through the heat seal 84. Finally, the lower sheet 60 is provided with an upwardly struck flap portion 86 which is heat-sealed to the downwardly struck flap portion 82 by means of a heat seal 88 in order to form an interior water chamber 90 and an air chamber 92, in the manner as illustrated in FIG. 12 of the drawings.

By comparing the structure created in accordance with the method of FIGS. 8 through 12, it can be seen that this water bed mattress created therein is substantially identical to the water bed mattress described in accordance with FIGS. 1–5 of the drawings. Thus, in this case, it can be observed that the upper sheet 76 is comparable to the upper wall 10, the lower sheet 60 is comparable to the lower wall 12, and the intermediate sheet 62, along with its flange portions 74, is comparable to the intermediate wall 22.

FIGS. 13–15 more fully illustrate the method of making the water bed mattress which is actually illustrated in FIG. 7 of the drawings. In this case, it can be observed that the mattress is constructed of a lower sheet 94, an intermediate sheet 96, and an upper sheet 98, and all of which are formed of a flexible plastic material. In this case, and by reference to FIG. 14, it can be observed that the intermediate sheet 96 is lap sealed to the lower sheet 94 along a continuous seal line 100 which is substantially identical to the seal 64. In this way, it can be observed that the seal 100 would be provided with longitudinal and transverse seal margins 66 and 68, respectively, and connected by the so-called "dog-legs" or outwardly projecting ends 70. The upper sheet 98 which is provided with outer peripheral end flaps 102 and the lower sheet 94 which is provided with outer peripheral end flaps 104 integrally engage therebetween outer peripheral end flanges 106 which are integral with the intermediate sheet 96. The terminal edges 102 and 104 of the flaps, and the terminal edge of the flange 106 are thereupon butt-sealed in the manner as illustrated in FIG. 15 of the drawings.

In this way, it can also be observed that a water chamber 108 is formed in such manner that the water chamber is bounded by the upper sheet 98 along with the flange portions 106 on the intermediate sheet 96. Moreover, an air chamber 110 is bounded by a portion of the lower wall 94 and the flanges 104 in combination with the flanges on the intermediate sheet 96. In this way, it can be observed that the water bed mattress created in accordance with the method of FIGS. 13–15 is similar to the water bed mattress created in accordance with the method of FIGS. 8–12 except that it adopts the configuration and construction as illustrated in FIG. 7 of the drawings.

FIG. 16 illustrates a modified form of water bed mattress constructed in accordance with and embodying the present invention and differs only from the water bed mattress previously described in that an arcuately shaped section 26b corresponding to the arcuately shaped section 26 connects the downwardly struck flange 28 and the intermediate wall 24 and is somewhat shorter than the total length of the wall 24 and flange 26. Moreover, the flange designated as 28b is heat-sealed to the struck flap 14 by means of a heat seal 30b. In this way, the arcuately shaped portion 26b is located somewhat beneath the upper sheet 10 by a few inches, but which nevertheless provides a water chamber for supporting a body but nevertheless supports the water chamber along its periphery by an air chamber. Otherwise, the construction of the water bed mattress, as illustrated in FIG. 16 is substantially identical to the construction of the water bed mattress illustrated in FIGS. 1–5 of the drawings. The water bed mattress as illustrated in FIG. 16 of the drawings does not otherwise differ from the water bed mattress illustrated in FIGS. 1–5 of the drawings except that the arcuately shaped section 26b is spaced below the sheet 10 and is secured to the lower flap 16, which most often is desireable in many constructions of the water bed mattress.

In addition, it can be observed that the flange 26b could also be sealed to the upwardly struck flap 16 or otherwise butt sealed as previously described. Nevertheless, an air chamber 38 extends peripherally around the entire outer wall of the water bed mattress A and, in this way, the air still chamber increases in size with the increased depth in the outer peripheral wall 22.

Referring now to FIG. 17 of the drawings which illustrate a more preferred embodiment of the present invention, a water bed mattress 112 is illustrated in a ridgid frame 114 supported on a base 116. This mattress comprising an upper flexible plastic sheet 118 and a lower flexible plastic sheet 120, and both of which are substantially rectangular in their construction, but with rounded corner margins.

The upper and lower sheets 118 and 120 are both substantially of the same overall size and are marginally registered with each other, and the upper sheet includes an integrally formed downwardly struck peripherally extending end flap 122. In like manner, the lower wall 120 includes an integrally formed upwardly struck peripherally extending flap 124 which is lap-sealed to the end flap 122 at a seal 126 thereby forming a peripheral outer end wall 128. In this case, it can be observed that the flap 122 which is integral with the upper wall 118 is located exteriorly of the flap 124 in order to form the lap-seal 124. However, it should also be understood that the flap 124 could be located exteriorly of the flap 122 in order to form the lap-seal 126, or otherwise a butt seal could be used.

The preferred embodiment of the water bed mattress of the present invention also includes a flexible plastic intermediate sheet 128 which has an interior intermediate section 130 disposed on the interiorly presented surface of the lower sheet 120 and which is integrally provided with a somewhat tapered peripherally extending inner side wall 132 which is more fully illustrated in FIG. 17 of the drawing. This inner peripheral wall 132 includes a diagonally inwardly and downwardly extending wall section 134 merging into the intermediate sheet 128 and which wall section 134 is formed at its upper end with an arcuately shaped section 136. This arcuately shaped section 136, in turn, integrally merges into a downwardly extending flange 138 which is essentially located in juxtaposition to the downwardly struck flap 124. The downwardly struck flange 138 is also lap-sealed to the interior surface of the flap 124 by means of a lap-seal 140.

The peripheral margin 142 of the intermediate sheet 128, that is the location where the sheet 128 merges into the side wall 132, is lap-sealed to the lower sheet 120 by means of a lap-seal 144.

By further reference to FIG. 17 of the drawings, it can be observed that the arcuately shaped section 136 of the inner peripheral wall 132 is located somewhat spaced below the peripheral margin of the upper wall 120. Nevertheless, the curved section 136 is located in approximate vertical registration with the corner margin extending between the upper wall 118 and the downwardly struck flap 122. However, it should be observed that in this embodiment of the invention, the size of the intermediate sheet bounded by the lap-seal 144 is relatively small compared to the inner wall 132. The intermediate sheet need be only large enough to accommodate the size of a conventional heating pad. Thus, the length of the lap seal 144 relative to the longitudinal dimension of the mattress could be one-eighth to seven-eighths and the ratio regarding the transverse dimension or width of the mattress would be the same.

In accordance with the above-outlined construction, it can be observed that the upper sheet 118 and the inner peripheral wall 132, along with the intermediate sheet 128 on the lower sheet 120, defines a water chamber 146. Moreover, it can be observed that the other side of the inner peripheral wall 132, along with the bottom wall 120 and the side wall 128, forms an outer air chamber 148. In this construction it can still be observed that the water chamber is substantially contiguous with the entire upper surface of the upper wall 118 in such manner that the entire upper surface of the water bed mattress is defined only by the water chamber. Nevertheless, it can also be observed that the air chamber 148 extends peripherally around the entire outer wall of the water bed mattress.

In each of the previously described embodiments of the water bed mattress of the present invention, any of a number of plastic materials may be used, and include for example, various forms of vinyl sheets, polyethylene, polystyrene, and polybutadiene copolymers and the like.

While the materials mentioned above are thermoplastics in nature, it should be understood that many thermosetting resins could also be used. In addition, various flexible non-plastic materials could also be employed, as for example, various textile materials which are water impervious and which may be plastic impregnated, such as those cloth materials which are impregnated with a vinyl plastic material to render the same water impervious. The upper and lower sheets as well as the outer and inner peripheral side walls should preferably have a thickness of no less than 20 mils. However, the desired thickness may be predicated upon the overall size of the mattress itself.

In addition to the foregoing advantages of the water bed mattresses of the present invention, these mattresses are highly unique in that they enable the user thereof to regulate the air pressure in the air bladder relative to the amount of water in the air bladder, and thereby provide adjustable support. In this way an individual may rest or sleep across the entire top surface of the mattresses which are supported on their periphery by an air bladder. In addition to the adjustable firmness, no bottoming-out can occur. Moreover, since the water bladder is smaller than water chambers in conventional water bed mattresses, the mattresses of the present invention can be filled quicker and drained quicker. Furthermore, due to less water content, less energy is required to heat the water to a desired water bed temperature. Thus, longer life is afforded to the water bed mattresses of the present invention since lesser pressure is exerted upon the various seams in the mattresses.

FIG. 18 represents a modified form of water bed mattress constructed in accordance with and embodying the present invention and which includes a top wall 150 and a spaced apart substantially parallel bottom wall 152. Each of the top and bottom walls 150 and 152 are respectively provided with downwardly and upwardly struck flaps 154 and 156 which are heat sealed at 158 in order to form an outer peripheral end wall, designated generally by reference numeral 160. In this case, any of the outer peripheral wall constructions could be utilized, as for example, that construction as illustrated in FIG. 7 of the drawings.

In any event, the water bed mattress of FIG. 18 includes an interior wall 162 which has an inclined section 164 and which is sealed to the bottom wall 152 at a heat seal 166 inwardly of the peripheral edge of the bottom wall 152 along the entire periphery thereof. Moreover, the diagonally extending wall section 164 integrally merges into an arcuate corner margin 168 which is spaced slightly below the interior surface of the top wall 150. In addition, this arcuate corner margin 168 integrally merges into a vertically disposed wall section 170 which is slightly spaced from the peripheral end wall 160. In this way, it can be observed that a liquid chamber, such as a water chamber 172, is formed with an air chamber 174 substantially surrounding the lower portion of the liquid chamber 172.

In addition, it can also be observed that a relatively thin fluid section 176 is in fluid communication with the fluid chamber 172 and actually forms part of the fluid chamber 172. It can be observed that this relatively thin fluid section 176 extends for the entire vertical dimension of the water bed mattress. Moreover, the vertically disposed section 170 of the intermediate wall 162 is heat sealed to the bottom wall 152 by means of a heat seal 178.

In accordance with the above-outlined construction, it can be observed that the liquid chamber 172 actually has a relatively thin portion thereof which completely surrounds the entire periphery of the water bed mattress such that the air chamber 174 is never contacted by a user engaging the top wall 150 or the peripheral end walls 160. In addition, it can be observed that an individual inclined on the upper surface of the water bed mattress, namely the upper wall 150, is always supported by fluid in the fluid chamber 172, and which also includes the fluid in the relatively thin fluid section 176.

FIG. 19 represents a further modified form of the water bed mattress of the present invention, and which is very similar in construction to FIG. 18. However, in this case, the water bed mattress which includes the upper wall 180 and the lower wall 182 and a peripheral end wall 184 have an interior wall 186 in the manner as illustrated in FIG. 19. This interior wall 186 includes a vertically disposed section 188 which also forms a relatively thin fluid section 190 in fluid communication with and forming part of a fluid chamber 192. However, in this case, the lower end of the vertically disposed section 188 is secured to the peripheral end wall 189 at a heat seal 194 in proximity to the lower margin thereof, and which also thereby defines an air chamber 196, in the manner as illustrated in FIG. 19.

FIG. 20 illustrates yet another embodiment of the water bed mattress similar to FIGS. 18 and 19, and which also includes an upper wall 198 and a lower wall 200, along with an outer peripheral end wall 202. In this case, the water bed mattress of FIG. 20 includes an interior wall 204 which is similar in construction to the interior wall 128 illustrated in FIG. 17 of the drawings, such that the interior wall 204 includes an upper arcuate end margin 206 which is spaced some distance beneath the top wall 198. Nevertheless, the arcuate section 206 integrally merges into a vertically disposed section 208 to thereby form a relatively thin fluid section 210 which communicates with and forms part of a fluid chamber 212. In like manner, the lower end of the vertically disposed section 208 can be heat sealed to the bottom wall 200 by means of heat seal 214 to thereby form an air chamber 216.

In the same respect, it can be observed that the heat seal 214 could be located along the outer peripheral end wall 202, in the same manner as illustrated in FIG. 19 of the drawings. In any event, it can be observed that the water bed mattress structure illustrated in FIG. 20 is similar to that of FIG. 17, except that the peripheral fluid section 210 is provided in thie case.

In each of the aforesaid embodiments of the water bed mattress described herein, these embodiments have been described in connection with the utilization of a water bladder and an air bladder. Nevertheless, the water bladder, or water chamber, may be provided with any liquid medium which is capable of reducing the overall weight of the water bed mattress. One of the primary problems in the use of many water bed mattresses is that the supporting structure, such as the floor in the house or other enclosure, is not oftentimes capable of supporting the weight of several hundred gallons of water. Consequently, it is desirable to reduce this weight as much as possible, without otherwise compromising the effects of the air bladder which are designed to reduce sharp impingement of localized forces, wave motion and the like. Thus, the water chamber is oftentimes referred to herein as a liquid or otherwise a fluid chamber and which may accommodate liquids other than water.

In many cases, the liquids could be provided with another substance in order to produce a specific weight thereof, but nevertheless provide the required support in the same manner as water provides such support. In addition, other materials may be incorporated in the air chamber so that air is not required to be introduced into this inner chamber. Moreover, by physically incorporating such solid or semi-solid materials in the chamber which normally incorporated the air chamber and which is hereinafter referred to as a "chamber containing a material therein" or the like, it is possible to eliminate the extra valve for introducing air into this chamber or bladder.

FIG. 21 illustrates another embodiment of a water bed mattress and which is similar to the water bed mattress illustrated in FIGS. 1–3 of the drawings. In this case, the water bed mattress comprises an upper wall 216, a lower wall 218, and a peripheral end wall 220. An intermediate wall 222 divides the mattress into a liquid containing chamber 224 and a material containing chamber 226. In this case, the fluid chamber 224 would normally contain a liquid, which could be water, or any other form of liquid. In many cases, the other liquid could actually be a mud solution. Nevertheless, the material containing chamber 226 could be provided with a solid material which, in this case, could be a urethane foam, or other foamable or plastic material. It can be observed that in the manufacture of the mattress, in this case, the urethane material could be formed by actually including a precatalyzed polyol and polyisocyanate, such as a diisocyanate, and which materials are reactive to form the actual urethane in order to completely fill the chamber 226.

FIG. 22 illustrates a further modified form of mattress of the present invention, and which similarly includes a liquid chamber 228 and a material containing chamber 230. In this case, the material containing chamber 230 may include any of those solid or semi-solid materials included in the chamber 226. Moreover, the fluid chamber 228 may include water or any other form of liquid material. However, in this case, microballoons 232 are incorporated in the liquid. These microballoons are wellknown in their construction, and therefore are neither illustrated nor described in any further detail herein. However, it is important to note that these microballoons do not hinder the support provided for an individual inclined on the upper surface of the mattress, but nevertheless substantially reduce the weight thereof. In the same respect, it should also be observed that a gelling agent could be included in the liquid chamber so that the liquid may be somewhat of a gel. In this case, while the liquid may be thickened, and actually be somewhat of a semi-solid or otherwise a semi-liquid, it is still referred to herein as a liquid. For example, such suitable gelling agents which may be used are carboxymethyl cellulose or the like.

FIG. 23 illustrates a form of mattress which is somewhat similar to the structure illustrated in FIG. 18, and which similarly includes a liquid chamber 234 and a material containing chamber 236, along with a peripherally extending fluid containing section 238 which actually communicates and forms part of the liquid chamber 234. In this case, the material containing chamber 236 may contain any of those materials which may be incorporated in the chambers 226 or 230, as previously described. In like manner, the liquid containing chamber 234 may contain any of those materials which were contained in the liquid chambers 224 or 228, as also previously described. In this connection, it can be observed that any of the mattress constructions, as heretofore described, could be urged with any of the liquids other than water and any solid or semi-solid material in place of air.

FIG. 24 illustrates a further modified form of mattress of the present invention, and which is similar to the mattress of FIGS. 21 and which includes a liquid chamber 240 and a material containing chamber 242. In this case, the material containing chamber 242 may include a pelletized form of material and the fluid chamber 240 may include water or any other form of liquid material.

Any of the mattresses illustrated in FIGS. 18–24 may also be constructed of any of those plastic materials which are mentioned above including the thermo setting materials. Moreover, each of the mattresses illustrated in FIGS. 18–24, and as described herein, are unique in that they reduce the overall weight of the mattress and, in addition, the pressure which is regulated by the chambers containing semi-solid material are adjusted so that they provide the proper support. Moreover, and in the same connection, an individual may rest or sleep across the entire top surface of the mattresses which are supported on their periphery by the material containing bladder or chamber. Consequently, even though air is not necessarily used in the material containing chamber, no bottoming-out can occur. Nevertheless, the fluid in the liquid containing chamber provides the necessary support.

Thus there has been illustrated and described various forms of novel mattress constructions, as well as methods for making the same, and which mattresses can be made at a relatively low cost and used in a wide variety of applications. Consequently, the mattresses described herein and the methods of making the same fulfill all the objects and advantages sought therefor. Many changes, modifications, variations and other uses and applications of water bed mattresses and the method of making the same will become apparent to those skilled in the art after considering this specification and the accompanying drawings. Therefore, any and all such changes, modifications, variations and other uses and applications which do not depart from the spirit and scope of the invention are deemed to be covered by the invention which is limited only by the following claims.

Having thus described my invention, what I desire to claim and secure by letters patent is:

1. A liquid containing mattress for supporting an individual in an inclined position comprising:

a. an upper sheet having a peripheral end margin, b. a lower sheet having a peripheral end margin and being in spaced apart relationship to said upper sheet, c. a first peripheral inner wall extending between and secured in operative relationship to said upper and lower sheets and forming a liquid chamber between said inner wall and upper and lower sheets, d. said inner wall being tapered so that it extends in proximate relationship to the peripheral end margin of said upper sheet to form said liquid chamber substantially continuous with the surface of said upper sheet, said inner wall extending inwardly from the peripheral end margin of said lower sheet and being secured to said lower sheet inwardly of its peripheral end margin, e. and a second peripheral outer wall extending between said upper and lower sheets forming a material containing chamber bounded by said outer and said inner wall and said lower sheet, and f. said inner wall having a section slightly disposed inwardly from said outer wall to form a relatively thin liquid space therebetween and said section being secured relative to said outer wall and said lower wall so that said liquid chamber is in fluid communication with and includes said relatively thin liquid space.

2. The liquid containing mattress of claim 1 further characterized in that said first peripheral inner wall having sections secured to said lower sheet.

3. The liquid containing mattress of claim 1 further charactered in that said outer wall having vertically struck portions which are sealed to said outer peripheral wall.

4. The liquid containing mattress of claim 1 further characterized in that said upper and lower sheets have angularly struck flaps which are respectively integral with said upper and lower sheets and which flaps are sealed to each other to form said outer peripheral wall, and said inner wall having a terminal peripherally extending flange which is sealed to one of said upper or lower walls or to said lower sheet.

5. The liquid containing mattress of claim 4 further characterized in that said flange is lap sealed to the flap integral with said lower wall.

6. The liquid containing mattress of claim 4 further characterized in that said flange is lap sealed to the flap integral with said lower wall.

7. The liquid containing mattress of claim 1 further characterized in that said upper and lower sheets have respective downwardly and upwardly struck flaps which are integral with said respective upper and lower sheets, said flaps having terminal flanges extending peripherally around the mattress, and said inner peripheral wall having a flange extending peripherally therearound, and each of said flanges being butt-sealed to one another.

8. The liquid containing mattress of claim 1 further characterized in that said upper and lower sheets and said inner and outer peripheral walls are formed of a flexible plastic material.

9. A liquid containing mattress for supporting an individual in an inclined position comprising:

a. an upper sheet having a peripheral end margin, b. a lower sheet having a peripheral end margin and being in spaced apart relationship to said upper sheet, c. a first peripheral inner wall extending between and secured in operative relationship to said upper and lower sheets and forming a liquid chamber between said inner wall and upper and lower sheets, d. said inner wall being tapered so that it extends in proximate relationship to the peripheral end margin of said upper sheet to form said liquid chamber substantially continuous with the surface of said upper sheet, said inner wall extending inwardly from the peripheral end margin of said lower sheet and being secured to said lower sheet inwardly of its peripheral end margin, e. and a second peripheral outer wall extending between said upper and lower sheets forming a material containing chamber bounded by said outer wall and said inner wall and said lower sheet, and said material containing chamber being filled with a relatively solid material having a specific weight which is substantially less than the specific weight of the liquid introduceable in said liquid chamber.

10. The liquid containing mattress of claim 9 further characterized in that said mattress is filled with water in said liquid chamber.

11. The liquid containing mattress of claim 9 further characterized in that weight reducing matter is included in the liquid in said liquid chamber.

12. The liquid containing mattress of claim 9 further characterized in that said material containing chamber is filled with a light-weight celled type material.

13. A liquid containing mattress comprised of upper and lower spaced apart walls, an outer peripheral wall extending between said upper and lower walls, an inclined inner peripheral wall extending between said upper and lower walls and having an inner wall section slightly spaced from said outer peripheral wall to form a liquid chamber between and substantially bounded by said upper wall and lower wall and the inner peripheral wall section and which is substantially contiguous along the surface of said upper wall, said inner peripheral wall extending inwardly with respect to said lower wall to form a material chamber between and substantially bounded by said lower wall and said outer wall and the inner peripheral wall section of said inner wall.

14. The liquid containing mattress of claim 13 further characterized in that said liquid chamber extends into a continuous peripheral space between the section on said inner peripheral wall and said outer wall.

15. The liquid containing mattress of claim 11 further characterized in that the material chamber is filled with a relatively solid material.

16. A method of making a mattress for supporting an individual in an inclined position comprised of a liquid chamber and a material chamber surrounding at least a portion of the liquid chamber, said method comprising:

a. disposing an intermediate flexible sheet over a lower flexible sheet, b. sealing a portion of the intermediate sheet inwardly of the peripheral edges of both said intermediate sheet and said lower sheet, thereby providing a continuous peripheral flap on said lower sheet and a continuous peripheral flange on said intermediate sheet, c. disposing an upper flexible sheet over said intermediate sheet, and which upper sheet has a continuous peripheral flap, d. forming an outer peripheral end wall associated with said peripheral flaps, and e. locating a portion of said flange in proximity to the peripheral margin of said upper sheet continuously therearound and sealing a terminal end of said flange along the entire periphery thereof with respect to said outer peripheral end wall to thereby form a liquid chamber bounded by said lower sheet and flange thereof and said upper sheet so that said liquid chamber is substantially coextensive with said upper sheet, and a material chamber bounded by said outer end wall, said lower sheet and said flange.

17. A liquid containing mattress for supporting an individual in an inclined position, said mattress comprising:

a. an upper sheet having a peripheral end margin, b. a lower sheet having a peripheral end margin and being in spaced apart relationship to said upper sheet, c. a peripheral inner wall extending between and secured in operative relationship to said upper and lower sheets and forming a liquid chamber between said inner wall and upper and lower sheets, d. said inner wall being inclined so that it extends in proximate relationship to the peripheral end margin of said upper sheet to form said liquid chamber substantially continuous with the surface of said upper sheet so that substantially the entire upper sheet is supported by liquid in said liquid chamber, and said inner wall extending inwardly from the peripheral end marging of said lower sheet and being secured to said lower sheet inwardly of its peripheral end margin, e. and a peripheral outer wall extending between said upper and lower sheets forming a material chamber bounded by said outer and said inner wall and lower sheet so that said material chamber when filled with a material provides continuous peripheral support by the material which is relatively less yieldable than the liquid in said liquid chamber, said liquid chamber having a periphery substantially contiguous with the periphery of said material chamber such that the material in said material chamber can provide continuous peripheral support.

18. The liquid containing mattress of claim 17 further characterized in that said peripheral outer wall having sections integral with said upper and lower sheets.

19. The liquid containing mattress of claim 17 further characterized in that said upper and lower sheets have angularly struck flaps which are respectively integral with said upper and lower sheets and which flaps are sealed to each other to form said outer peripheral wall.

20. The liquid containing mattress of claim 17 further characterized in that said upper and lower sheets have angularly struck flaps which are respectively integral with said upper and lower sheets and which flaps are lap sealed to each other to form said outer peripheral wall, and said inner wall having a terminal peripherally extending flange which is lap sealed to one of the flaps integral with said upper and lower sheets.

21. The liquid containing of claim 17 further characterized in that said upper and lower sheets and said inner and outer peripheral walls are formed of a flexible plastic material.

22. The liquid containing mattress of claim 17 further characterized in that said water bed mattress is provided with a closeable air inlet communicating with said air chamber and a closeable water inlet communicating with said water chamber.

23. The liquid containing mattress of claim 20 further characterized in that said inner wall is provided with a second terminal peripherally extending flange which is lap-sealed to said lower sheet.

24. A liquid containing mattress for supporting an individual in an inclined position, said mattress comprised of upper and lower spaced apart walls, an outer peripheral wall extending between said upper and lower walls, an inclined inner peripheral wall extending between said upper and lower walls to form a liquid chamber between and substantially bounded by said upper wall and lower wall and inner peripheral wall, said inner peripheral wall having an upper portion which extends in proximate relationship to the peripheral end margin of said upper wall to form said liquid chamber substantially continuous with said upper wall so that substantially the entire upper wall is supported by liquid in said liquid chamber, said inner peripheral wall extending inwardly with respect to the peripheral end margin of said lower wall and being secured thereto to form a material chamber between and substantially bounded by said lower wall and said outer wall and said inner wall, said material chamber when filled with a material providing continuous peripheral support by the material which is relatively less yieldable than the liquid in said liquid chamber, said liquid chamber having a periphery substantially contiguous with the periphery of said material chamber such that the material in said material can provide continuous peripheral support.

25. The liquid containing mattress of claim 24 further characterized in that the outer peripheral wall is comprised of flaps integral with said upper and lower walls and which flaps are sealed to each other.

26. A liquid containing matteress for supporting an individual in an inclined position, said mattress comprising:

a. an upper sheet formed of a flexible plastic material and having a peripheral end margin, b. a lower sheet formed of a flexible plastic material and having a peripheral end marging and being in spaced apart relationship to said upper sheet, c. a peripheral inner wall formed of a flexible plastic material, said inner wall extending between and secured in operative relationship to said upper and lower sheets and forming a liquid chamber between said inner wall and upper and lower sheets, d. said inner wall having a inclined portion extending from said upper sheet inwardly toward and to said lower sheet, said inner wall having a curved upper portion extending from said inclined portion so that the curved upper portion extends in proximate relationship to the peripheral end marging of said upper sheet to form said liquid chamber substantially continuous with the surface of said upper sheet so that substantially the entire upper sheet is supported by liquid in said liquid chamber, said inclined wall having an attachment strip extending from the curved upper portion and being secured to said mattress at points other than said upper sheet, said inner wall extending inwardly from the peripheral end marging of said lower sheet and having a lower portion secured to said lower sheet inwardly of its peripheral end margin, e. a peripheral outer wall formed of a flexible plastic material, said outer wall extending between said upper and lower sheets forming a material chamber bounded by said outer and said inner wall and said lower sheet so that said material chamber when filled with a material provides continuous peripheral support by the material which is relatively less yieldable than the liquid in said liquid chamber, said liquid chamber having a periphery substantially contiguous with the periphery of said material chamber such chat the material in said material chamber can provide continuous peripheral support, f. a closeable material inlet communicating with said material chamber, g. and a closeable liquid inlet communicating with said liquid chamber.

27. The water bed liquid containing mattress of claim 26 further characterized in that said upper and lower sheets have angularly struck flaps which are respectively integral with said upper and lower sheets and which flaps are sealed to each other to form said outer peripheral wall.

28. The water bed liquid containing mattress of claim 26 further characterized in that said upper and lower sheets have angularly struck flaps which are respectively integral with said upper and lower sheets and which flaps are lap sealed to each other to form said outer peripheral wall, and said inner wall having a terminal peripherally extending flange which is lap sealed to one of said flaps integral with said upper or lower sheets.

29. A liquid containing mattress comprised of upper and lower spaced apart walls, an outer peripheral wall extending between said upper and lower walls, an inclined inner peripherally extending wall extending between said lower wall and said outer peripheral wall and having an inner wall section spaced from said upper wall to form a liquid chamber between and substantially bounded by said upper wall and lower wall and the inner wall, said inner wall extending inwardly with respect to said lower wall to form a material chamber between and substantially bounded by said lower wall and said outer peripheral wall and the inner wall, said material chamber when filled with a material providing continuous peripheral support by the material which is relatively less yieldable than the liquid in said liquid chamber, said liquid chamber having a periphery substantially surrounding the periphery of said material chamber such that the material in said material can provide continuous peripheral support.

30. The liquid containing water bed mattress of claim 29 further characterized in that said upper and lower walls have angularly struck flaps which are respectively integral with said upper and lower walls and which flaps are sealed to each other to form said outer peripherally extending wall, and said inner wall having a terminal peripherally extending flange which is sealed to one of the flaps integral with said upper and lower walls.

31. The liquid containing water bed mattress of claim 29 further characterized in that said inner wall is provided with a first terminal peripherally extending flange which is sealed to said outer peripheral wall and a second terminal peripherally extending flange which is sealed to said lower wall.

32. The liquid containing water bed mattress of claim 29 further characterized in that said mattress is filled with water in said liquid chamber.

33. The liquid containing water bed mattress of claim 29 further characterized in that weight reducing matter is included in the liquid in said liquid chamber.

34. The liquid containing water bed mattress of claim 29 further characterized in that said material containing chamber is filled with a light-weight celled type material.

* * * * *